US010421215B1

(12) United States Patent
Swisher

(10) Patent No.: US 10,421,215 B1
(45) Date of Patent: Sep. 24, 2019

(54) MORTAR MIXER PADDLE ASSEMBLY FOR USE WITH POLYETHYLENE DRUMS AND ASSOCIATED METHODS

(71) Applicant: James A Swisher, Jacksonville, FL (US)

(72) Inventor: James A Swisher, Jacksonville, FL (US)

( * ) Notice: Subject to any disclaimer, the term of this patent is extended or adjusted under 35 U.S.C. 154(b) by 0 days.

(21) Appl. No.: 16/160,858

(22) Filed: Oct. 15, 2018

Related U.S. Application Data

(60) Provisional application No. 62/573,784, filed on Oct. 18, 2017.

(51) Int. Cl.
*B28C 5/14* (2006.01)
*B01F 7/00* (2006.01)
*B01F 7/04* (2006.01)

(52) U.S. Cl.
CPC ..... *B28C 5/14* (2013.01); *B01F 7/00133* (2013.01); *B01F 7/00158* (2013.01); *B01F 7/00208* (2013.01); *B01F 7/04* (2013.01); *B01F 2215/0047* (2013.01)

(58) Field of Classification Search
CPC ..... B28C 5/12; B28C 5/14; B01F 7/00133; B01F 7/00158; B01F 7/00208; B01F 7/04; B01F 7/00166; B01F 2215/0047
USPC ..... 366/3, 14
See application file for complete search history.

(56) References Cited

U.S. PATENT DOCUMENTS 338,121 A * 3/1886 Wallace ..... A21C 1/06 366/99
2004/0009610 A1* 1/2004 Schabron ..... B01F 7/22 436/178
2005/0195682 A1* 9/2005 Swisher ..... B01F 7/00025 366/47
2008/0101153 A1* 5/2008 Swisher ..... B01F 7/00133 366/47

* cited by examiner

*Primary Examiner* — Marc C Howell
(74) *Attorney, Agent, or Firm* — Ashkan Najafi

(57) ABSTRACT

The mortar mixer paddle assembly includes a rectilinear shaft having a centrally registered longitudinal axis, a tow-end and an engine-end axially opposed from the tow-end, and a plurality of rectilinear paddle arms radially extending outwardly from the centrally registered longitudinal axis. A mechanism for entraining air into the mortar mixture and along the rectilinear shaft inside the existing polyethylene drum is provided. A mechanism for horizontally reciprocating a mortar mixture slurry along a bi-directional linear travel path parallel to the centrally registered longitudinal axis of the rectilinear shaft is provided. A mechanism for radially redirecting slow-moving mortar mixture slurry, traveling along the rectilinear shaft, upwards into faster moving arcuate travel paths rotating about the rectilinear shaft thus eliminating mortar mixture slurry build-up on the rectilinear shaft and the rectilinear paddle arms is provided.

11 Claims, 5 Drawing Sheets

MORTAR MIXER PADDLE ASSEMBLY FOR USE WITH POLYETHYLENE DRUMS AND ASSOCIATED METHODS

CROSS REFERENCE TO RELATED APPLICATIONS

This is a non-provisional patent application that claims the benefit of U.S. provisional patent application No. 62/573,784 filed Oct. 18, 2017, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure generally relate to portable masonry mortar mixers paddles and, more particularly, to a portable mortar mixer operating at a slow mixing speed, and employed with a polyethylene drum, for making it easier to clean the mortar mixer on the jobsite by eliminating slurry build-up on all components of the mortar mixer paddle assembly. Air-generating paddles force entrained air into the mixing batch to provide creamy and consistent mortar (e.g., homogenous mortar), without the use of chemical additives (e.g., surfactant), for reducing sand clumps remaining in the mortar after completing a mortar mixing process.

Prior Art

For many years, the concrete industry has been using special chemical additives to ensure that their produced concrete has elevated levels of entrained air which in turn guarantees its concrete has a highest strength when cured. Somehow, the masonry industry has remained, for the most part, unfamiliar with the numerous benefits of mortar enriched with entrained air. Thus, the masonry industry and their contractors are always looking for improvements with the mixers they use to produce the mortar that they require every working day. Because this work is so difficult, and the materials are so heavy, the contractor tries to have the best mixer possible to perform the mortar mixing process. Each day that the mortar mixer is used, at day's end, this mixer must be thoroughly cleaned on the jobsite. Remaining unwanted cured mortar is extremely difficult to remove the next morning.

Cleaning the mortar mixer at day's end is always a challenge. This is especially true where the mason can only use a limited amount of water. Such is the case when the mortar is being mixed on the upper floors of a high-rise building. Many jobsites prohibit excessive water flow on the ground in the mixing area for safety reasons.

The inventor of the present application is also the inventor of U.S. Pat. No. 7,559,687 issued Jul. 14, 2009, incorporated by reference herein. Such a mortar mixer is intended for use with steel mortar mixing drums because the traditional paddles can slidably engage the interior surface of the steel mortar mixing drum.

However, polyethylene mortar mixing drums (polyethylene drum) have become more popular in the mortar mixer market lately because many equipment rental companies that purchase these mortar mixers believe that the job of keeping them clean is made easier with the polyethylene drum rather than the conventional drum made from steel. Because the polyethylene drum does not wear as well as the conventional steel drum, mortar mixer production time is increased stemming from the use of the traditional rectilinear shaft and steel paddles, which cannot engage the polyethylene drum's interior surface. This fact is true because the polyethylene drum paddles apply less mixing pressure in each mortar batch. In addition, the paddle blade's rubber wipers are never allowed to contact the interior surface of the polyethylene drum wall as they are with the steel drum. The spatial distance between the paddle components and an interior surface of the polyethylene drum is critical and necessary to prevent undesirable wear and tear to thereto during repeated mixing processes. Thus, less mixing pressure requires more mixing time to complete the mixing process for each mortar batch.

Accordingly, a need remains for a portable mortar mixer in order to overcome at least one aforementioned shortcoming. The exemplary embodiment(s) satisfy such a need by providing a portable mortar mixer that is convenient and easy to use, lightweight yet durable in design, versatile in its applications, and designed for operating at a slow mixing speed, and employed with a polyethylene drum, thereby making it easier to clean the mortar mixer on the jobsite by eliminating slurry build-up on all components of the mortar mixer paddle assembly. Air-generating paddles force entrained air in to the mixing batch to provide creamy and consistent mortar, without the use of chemical additives, for reducing sand clumps remaining in the mortar after completing a mortar mixing process.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a portable mortar mixer operating at a slow mixing speed, and employed with a polyethylene drum, for making it easier to clean the mortar mixer on the jobsite by eliminating slurry build-up on all components of the mortar mixer paddle assembly. Air-generating paddles force entrained air in to the mixing batch to provide creamy and consistent mortar, without the use of chemical additives, for reducing sand clumps remaining in the mortar after completing a mortar mixing process. These and other objects, features, and advantages of the non-limiting exemplary embodiment(s) are provided by a mortar mixer paddle assembly for operating at a slow mixing speed inside a polyethylene drum.

The mortar mixer paddle assembly includes a rectilinear shaft having a centrally registered longitudinal axis and configured to be operably articulated along a unidirectional counter clockwise rotation while positioned in an existing polyethylene drum for preparing a mortar mixture. Such a rectilinear shaft includes a tow-end and an engine-end axially opposed from the tow-end, and a plurality of rectilinear paddle arms radially extending outwardly from the centrally registered longitudinal axis. The mortar mixer paddle assembly further includes a mechanism for entraining air into the mortar mixture and along the rectilinear shaft inside the existing polyethylene drum. The mortar mixer paddle assembly further includes a mechanism for horizontally reciprocating a mortar mixture slurry along a bi-directional linear travel path parallel to the centrally registered longitudinal axis of the rectilinear shaft. The mortar mixer paddle assembly further includes a mechanism for radially redirecting slow-moving mortar mixture slurry, traveling along the rectilinear shaft, upwards into faster moving arcuate travel paths rotating about the rectilinear shaft thus eliminating mortar mixture slurry build-up on the rectilinear shaft and the rectilinear paddle arms.

In a non-limiting exemplary embodiment, the mechanism for entraining air into the mortar mixture and along the rectilinear shaft inside the existing polyethylene drum includes a plurality of air-generating paddles statically coupled to said rectilinear shaft and being arranged in a pre-defined orientation relative to the tow-end and the engine-end of the rectilinear shaft.

In a non-limiting exemplary embodiment, the mechanism for horizontally reciprocating a mortar mixture slurry along a bi-directional linear travel path parallel to the centrally registered longitudinal axis of the rectilinear shaft includes a plurality of lateral paddles statically affixed to a first group of the paddle arms and being spaced from the air-generating paddles, respectively.

In a non-limiting exemplary embodiment, the mechanism for radially redirecting slow-moving mortar mixture slurry, traveling along the rectilinear shaft, upwards into faster moving arcuate travel paths rotating about the rectilinear shaft includes a plurality of venturi mid-paddles statically affixed to a second group of the paddle arms and being intermediately positioned between the plurality of air-generating paddles and the plurality of lateral paddles, and a plurality of lateral mid-paddles statically affixed to the second group of the paddle arms and being intermediately positioned between the plurality of air-generating paddles and the plurality of lateral paddles. Each of the plurality of venturi mid-paddles has a trapezoidal shape. Advantageously, the plurality of venturi mid-paddles are juxtaposed to the plurality of lateral mid-paddles, respectively.

In a non-limiting exemplary embodiment, the plurality of air-generating paddles includes a first pair of air-generating paddles registered along a first x-axis and being disposed adjacent to the tow-end of the rectilinear shaft, and a second pair of air-generating paddles registered along a second x-axis and being disposed adjacent to the engine-end of the rectilinear shaft. Notably, the first x-axis is oriented parallel to the second x-axis and orthogonal to the centrally registered longitudinal axis of said rectilinear shaft. The centrally registered longitudinal axis is a y-axis.

In a non-limiting exemplary embodiment, the plurality of lateral paddles includes a first lateral paddle registered along a first z-axis and being disposed adjacent to the tow-end of the rectilinear shaft, and a second lateral paddle registered along a second z-axis and being disposed adjacent to the engine-end of the rectilinear shaft. Each of the first lateral paddle and the second lateral paddle are oriented substantially perpendicular to each of the first pair of air-generating paddles and the second pair of air-generating paddles. Advantageously, the first lateral paddle is coextensively shaped to the second lateral paddle. Notably, wherein each of said first z-axis and said second z-axis are obliquely angled relative to said first x-axis and said second x-axis as well as said y-axis.

In a non-limiting exemplary embodiment, the plurality of lateral mid-paddles includes a first lateral mid-paddle intermediately positioned between the tow-end and the engine-end of the rectilinear shaft, and a second lateral mid-paddle intermediately positioned between the tow-end and the engine-end of the rectilinear shaft, the second lateral mid-paddle being opposed from and oppositely facing the first lateral mid-paddle. Advantageously, the first lateral mid-paddle and the second lateral mid-paddle are equidistantly offset from the rectilinear shaft.

In a non-limiting exemplary embodiment, the plurality of venturi mid-paddles includes a first venturi mid-paddle mounted adjacent to the first lateral mid-paddle and being configured to rotate in sync with the first lateral mid-paddle thereby causing the mortar mixture slurry to horizontally flow along the y-axis towards the engine-end of the rectilinear shaft. A second venturi mid-paddle is mounted adjacent to the second lateral mid-paddle and being configured to rotate in sync with the second lateral mid-paddle thereby causing the mortar mixture to horizontally flow along the y-axis towards the tow-end of the rectilinear shaft. Advantageously, the first venturi mid-paddle is oppositely positioned across from the rectilinear shaft relative to a position of the second venturi mid-paddle. Notably, the first venturi mid-paddle is coextensively shaped to the second venturi mid-paddle.

In a non-limiting exemplary embodiment, the first pair of air-generating paddles is transversely offset 180 degrees relative to the centrally registered longitudinal axis of the rectilinear shaft and located adjacent to the interior surface of the existing polyethylene drum at the tow-end of the rectilinear shaft. Similarly, the second pair of air-generating paddles is transversely offset 180 degrees relative to the centrally registered longitudinal axis of the rectilinear shaft and located adjacent to the interior surface of the existing polyethylene drum at the engine-end of the rectilinear shaft.

The present disclosure further includes a method of utilizing a mortar mixer paddle assembly for operating at a slow mixing speed inside a polyethylene drum. Such a method includes the initial step of: providing a rectilinear shaft having a centrally registered longitudinal axis and configured to be operably articulated along a unidirectional counter clockwise rotation while positioned in an existing polyethylene drum for preparing a mortar mixture. Such a rectilinear shaft includes a tow-end and an engine-end axially opposed from the tow-end, and a plurality of rectilinear paddle arms radially extending outwardly from the centrally registered longitudinal axis.

The method further includes the steps of: providing a mechanism for entraining air into the mortar mixture and along the rectilinear shaft inside the existing polyethylene drum; providing a mechanism for horizontally reciprocating a mortar mixture slurry along a bi-directional linear travel path parallel to the centrally registered longitudinal axis of the rectilinear shaft; and providing a mechanism for radially redirecting slow-moving mortar mixture slurry, traveling along the rectilinear shaft, upwards into faster moving arcuate travel paths rotating about the rectilinear shaft thus eliminating mortar mixture slurry build-up on the rectilinear shaft and the rectilinear paddle arms; and producing a consistent and creamy mortar mixture while minimizing the mortar mixture slurry undesirably stuck to the rectilinear shaft.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
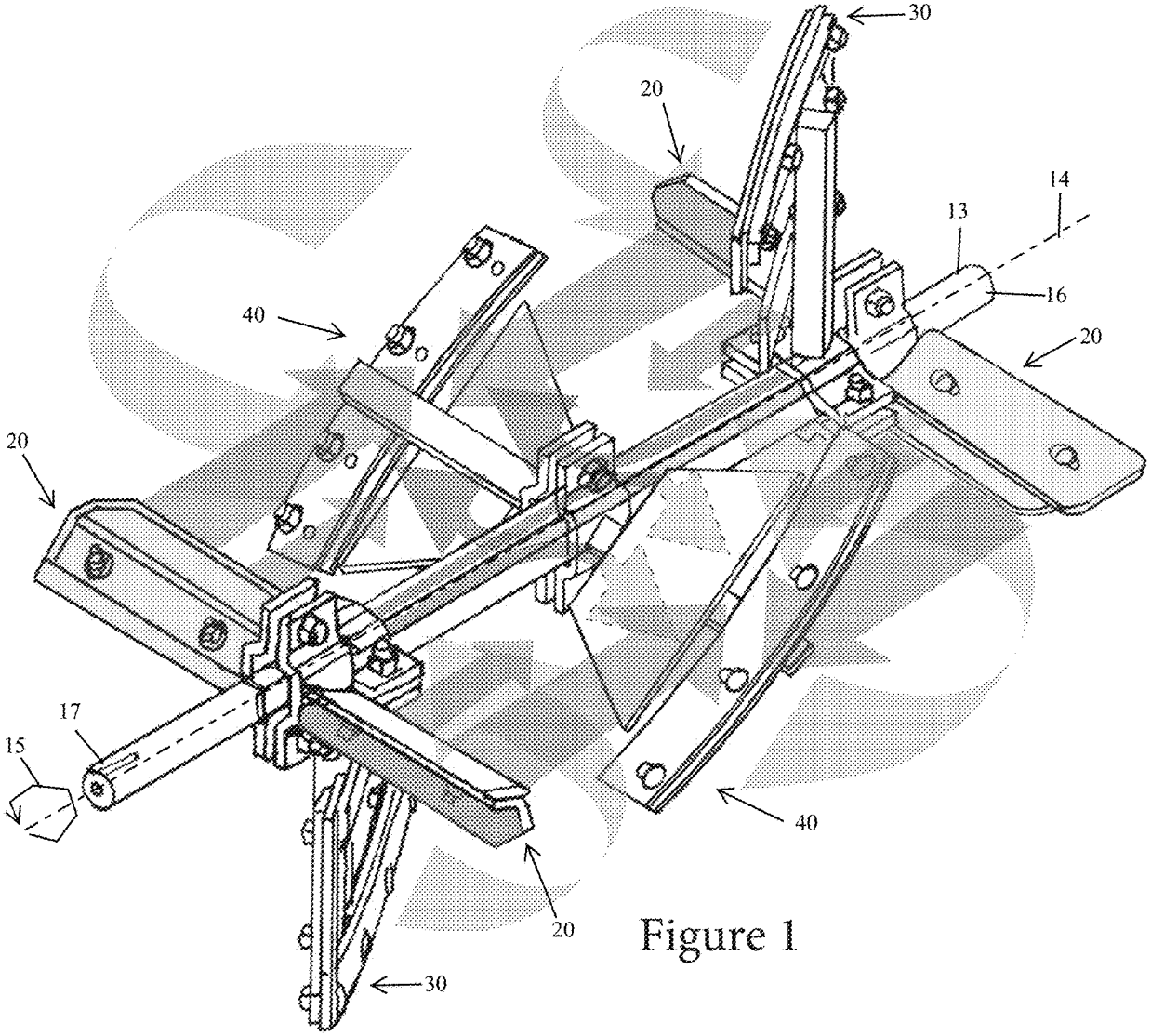
FIG. 1 is a perspective view of a portable mortar mixer for use with a polyethylene drum wherein each of the horizontal flow, lateral flow, and venturi flow is illustrated with directional arrows, in accordance with a non-limiting exemplary embodiment of the present disclosure.
Figure 2:
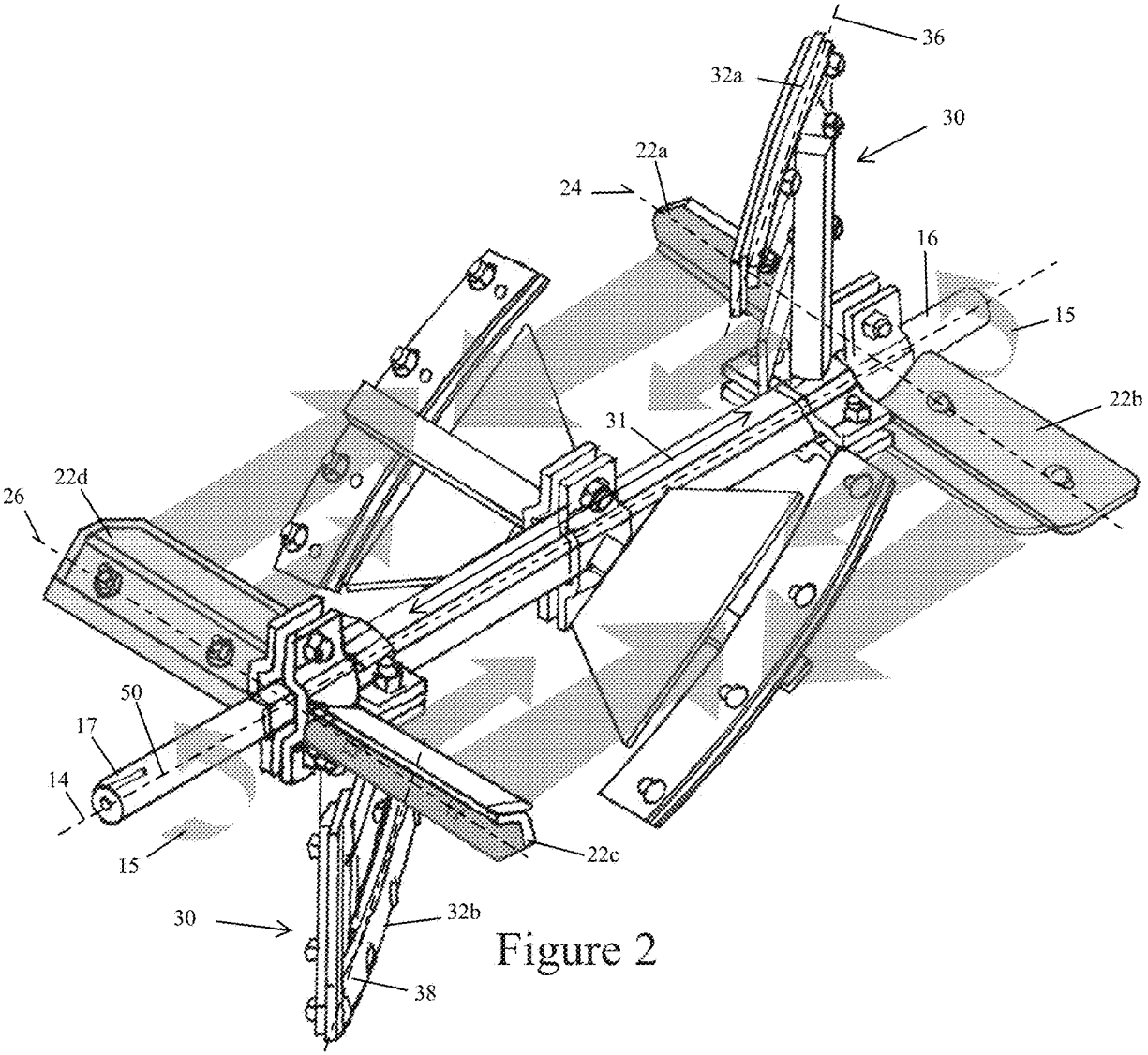
FIG. 2 is a perspective view of the portable mortar mixer in FIG. 1, wherein the horizontal flow created by the air-generating paddles is illustrated.
Figure 3:
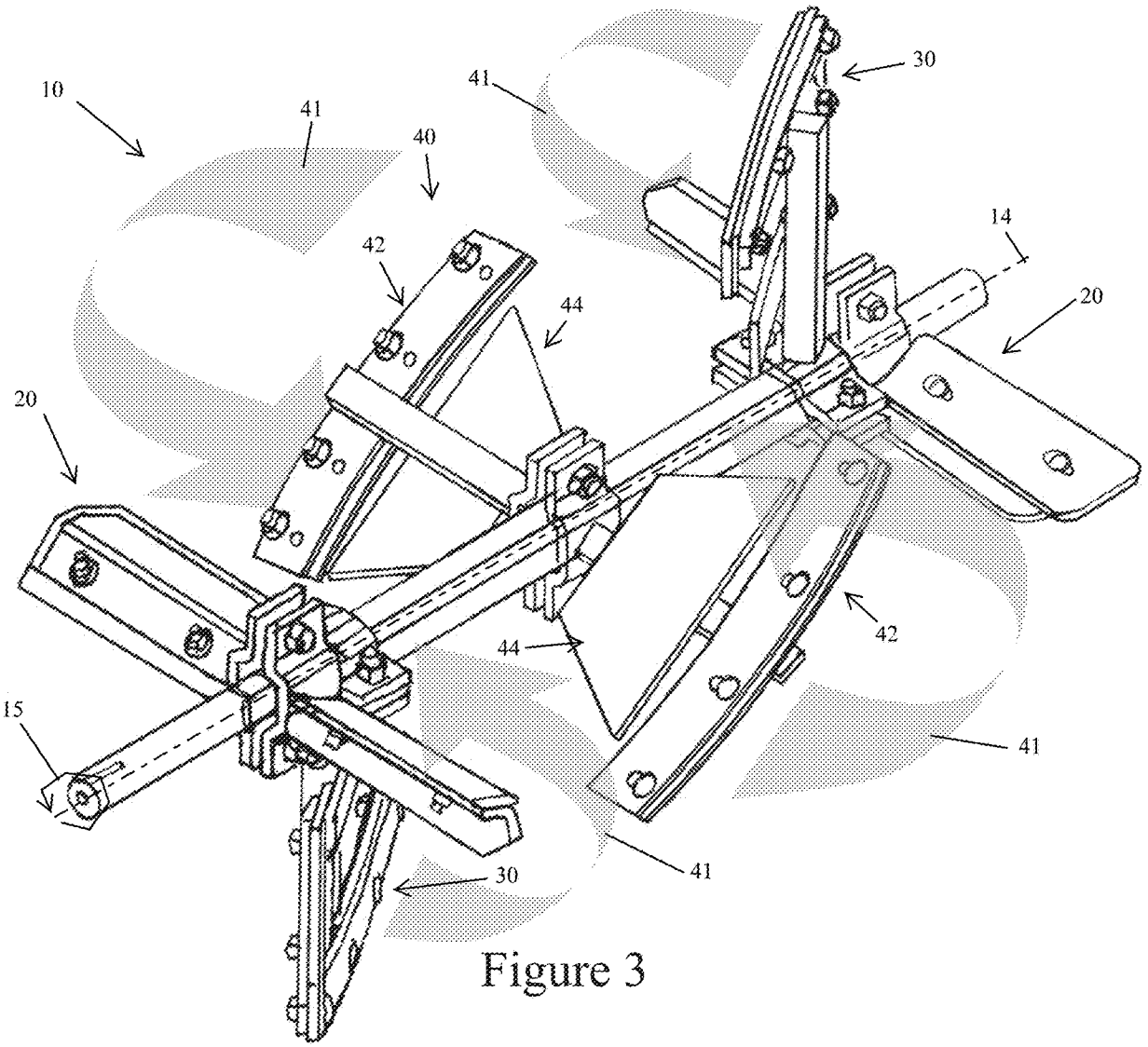
FIG. 3 is a perspective view of the portable mortar mixer in FIG. 1, wherein the lateral flow created by the lateral paddles is illustrated.
Figure 4:
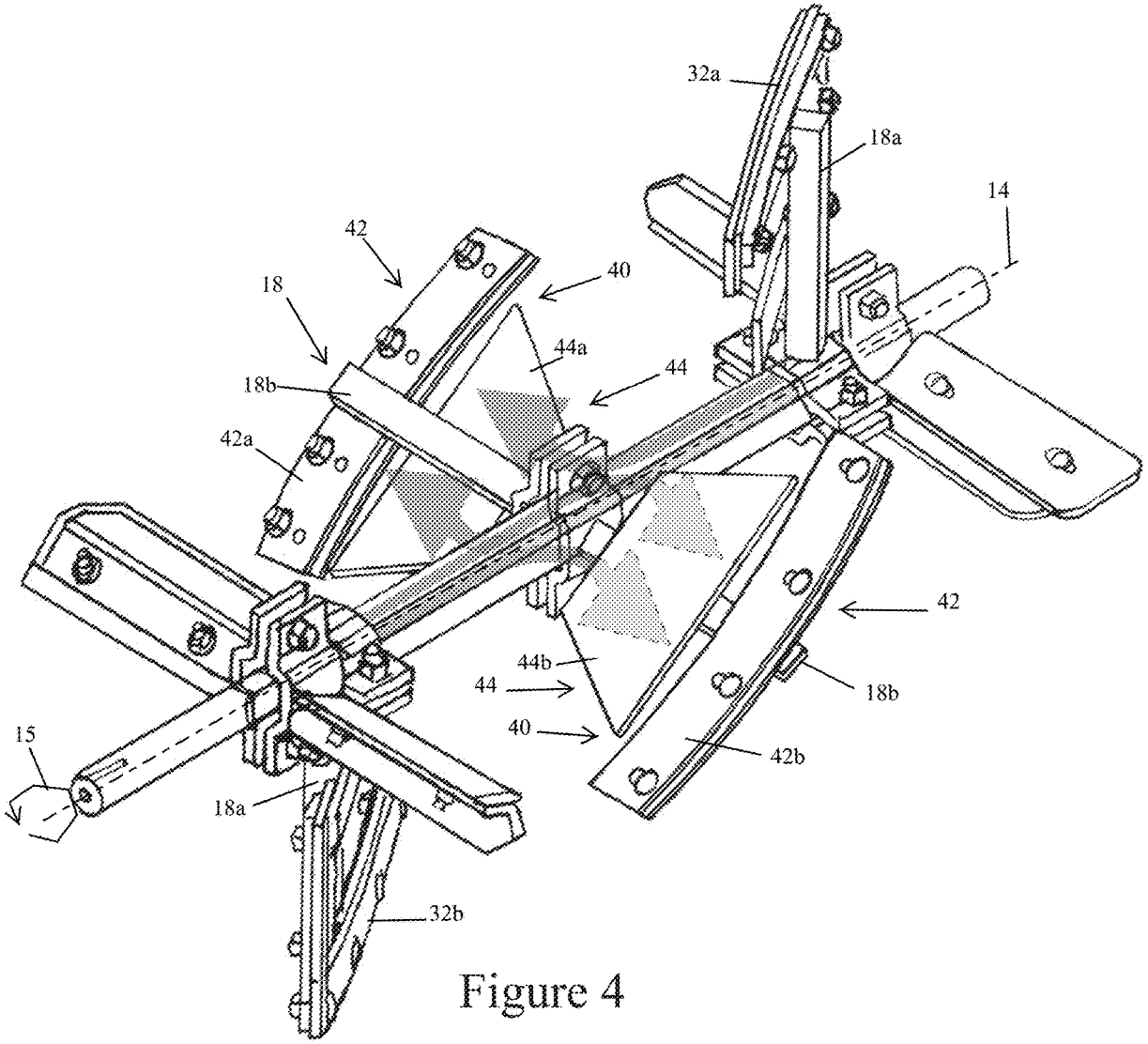
Figure 5:
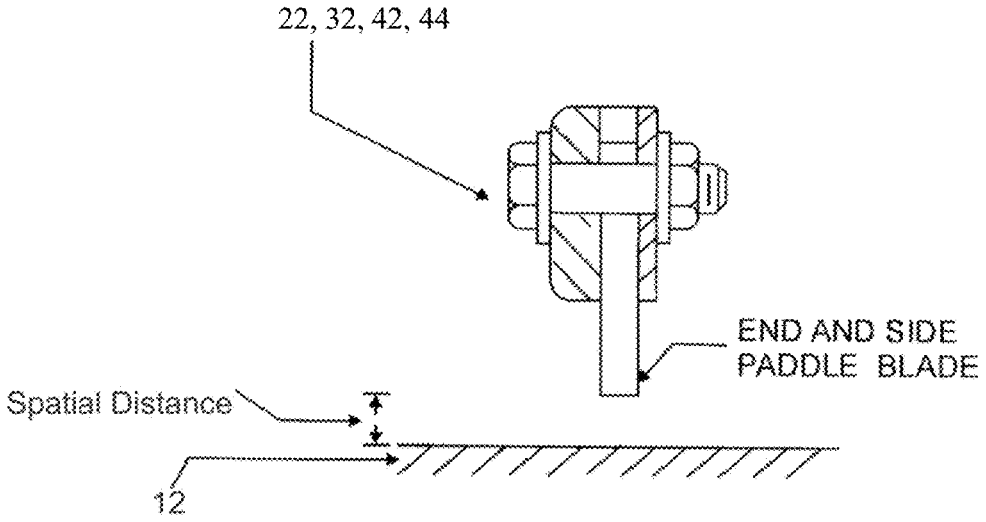

FIG. 4 is a perspective view of the portable mortar mixer in FIG. 1, wherein the venturi flow created by the venturi mid-paddles is illustrated for redirecting the slow-moving slurry towards the faster moving arcuate travel paths near the interior surface of the polyethylene drum; and FIG. 5 is an enlarged cross-sectional view showing a spatial distance between an exemplary paddle and the interior surface of the polyethylene drum to avoid damage to the polyethylene drum.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The terms "PolyFast Mortar Mixing System," "PolyFast System," "Mortar Mixer," "Mortar Mixing System," and similar terms are interchangeably used throughout the present disclosure.

The terms "mortar," "mixing mortar," "mortar mixture," "mortar batch," "mixing batch," and similar terms are interchangeably used throughout the present disclosure.

The term "slurry" means slow-moving mortar mixture ingredients that have not been adequately mixed to a suitable consistency within the polyethylene drum.

The terms "slow mixing speed" means the rectilinear shaft rotates approximately 36 revolutions per minute inside the polyethylene drum.

A detailed explanation of selected components of the present disclosure is found in aforementioned U.S. Pat. No. 7,559,687, incorporated by reference herein. The polyethylene drum has a similar structure as the steel drum shown in U.S. Pat. No. 7,559,687 but is made from polyethylene material rather than steel and is not necessarily symmetrical in shape.

The non-limiting exemplary embodiment(s) is/are referred to generally in FIGS. 1-5 and is/are intended to provide a portable mortar mixer paddle assembly 10 operating at a slow mixing speed, and employed with a polyethylene drum (similar structure—not same material—as shown in U.S. Pat. No. 7,559,687, see paragraph hereinabove), for making it easier to clean the polyethylene drum on the jobsite by eliminating slurry build-up on all components of the mortar mixer paddle assembly 10. Air-generating paddles 22 force entrained air in to the mixing batch to provide creamy and consistent mortar, without the use of chemical additives, for reducing sand clumps remaining in the mortar after completing a mortar mixing process. This present disclosure also provides an inexpensive way for the masonry trade to upgrade their mixers so that every mixed batch of mortar produced will have an elevated level of entrained air. By installing the four air-generating paddles 22 with their unique drum 11 placement, it is possible to produce a significant level of naturally aspirated "entrained air". These four air-generating paddles 22 reduce the mixing process time by 30%.

This new mortar mixer paddle assembly 10 offers real benefits to the mason and makes him more efficient and profitable each day: fastest mortar production; highest quality of mixed mortar; greatest spread ability and overcomes the negative effects of coarse-grained sand; longest board life due to elevated levels of entrained air and lower batch temperatures; and a mortar mixer that almost cleans itself. Eliminating the sand clumps that remain in the mortar after completing the mortar mixing process is a huge benefit, thereby saving labor expense to eliminate the sand clumps to ensure that the mixed mortar batch is ready for the mason's trowel. This also eliminates related waste of unusable mortar. The sand clumps appear when the mortar mixture batch is completely mixed and poured out into a large mortar box. The sand clumps do not remain in the polyethylene drum; sand clumps stay in the mortar mixture extracted from the polyethylene drum. They must be removed by hand once the mortar has been taken from the polyethylene drum. Both "removing sand clumps by hand" and then the waste of costly unusable produced mortar mixture related to the clump removal are both factors that save labor and material costs.

The mortar mixer paddle assembly 10 includes a rectilinear shaft 13 having a centrally registered longitudinal axis 14. Such a rectilinear shaft 13 is configured to be operably articulated along a unidirectional counter clockwise rotation 15 while positioned in an existing polyethylene drum for preparing a mortar mixture. Such a rectilinear shaft 13 includes a tow-end 16 and an engine-end 17 axially opposed from the tow-end 16, and a plurality of rectilinear paddle arms 18 radially extending outwardly from the centrally registered longitudinal axis 14. The mortar mixer paddle assembly 10 further includes a mechanism 20 for entraining air into the mortar mixture and along the rectilinear shaft 13 inside the existing polyethylene drum. The mortar mixer paddle assembly 10 further includes a mechanism 30 for horizontally reciprocating a mortar mixture slurry along a bi-directional linear travel path 31 parallel to the centrally registered longitudinal axis 14 of the rectilinear shaft 13. The mortar mixer paddle assembly 10 further includes a mechanism 40 for radially redirecting slow-moving mortar mixture slurry, traveling along the rectilinear shaft 13, upwards into faster moving arcuate travel paths 41 rotating about the rectilinear shaft 13, thus eliminating mortar mixture slurry build-up on the rectilinear shaft 13 and the rectilinear paddle arms 18. The present disclosure yields the unpredicted and unexpected results of significantly reducing the required mortar mixing time by employing specially designed paddles (as described hereinbelow). The mortar mixture is the highest quality because the applied mixing pressures eliminates sand clumps. The applied mixing pressures also make it possible for the mortar mixture to attain "complete batch rotation" which means that the entire batch is in motion and all mortar slurries are absorbed into the rotating batch.

The present disclosure yields the unpredicted and unexpected results of optimizing the level of entrained air in the polyethylene drum. This is made possible by the addition of four air-generating paddles 22 (22*a*-22*d*), which produce an elevated level of entrained air that delivers the best mortar spread ability (e.g., mortar stays plastic (pliable) for a longer time), and thus improves the actual productivity of the mason. This elevated level of entrained air improves the molecular attraction by which the particles of the mixing mortar are united throughout the batch. The effects are so pronounced that this mortar is referred to as "alive". The entrained air bubbles act like tiny ball bearings lubricating the mortar. This unique natural effect enables the present disclosure to supply the highest jobsite producible quality mortar available without having to add expensive chemical additives to each mortar mixture batch.

The present disclosure yields the unpredicted and unexpected results of altering the slurry flow mixing patterns of the slowly rotating mortar in the polyethylene drum by employing at least two new venturi mid-paddles 44*a*, 44*b* (collectively at 44). Such venturi mid-paddles 44*a*, 44*b* create additional force that redirects the slow-flowing slurry of the mortar mixture to move horizontally along the rectilinear shaft 13 outer surface thereby lifting it vertically and returning this slurry to the more rapidly flowing lateral outside flow (arcuate travel paths 41) of the rotating batch. This additional applied force helps eliminate the unwanted buildup of mortar on rectilinear shaft 13 outer surface that must be cleaned daily. Thus, the present disclosure provides a "self-cleaning" benefit not found with conventional mortar mixers.

In a non-limiting exemplary embodiment, rubber wipers may be optionally employed because the paddles (collectively at 22, 32, 42, 44) are not allowed to contact the inner wall (interior surface 12) of the polyethylene drum. Repeated contact would damage the interior surface 12.

In a non-limiting exemplary embodiment, new backer plates (see U.S. Pat. No. 7,559,687 for an explanation of backer plates) have been made stronger and redesigned to be adjustable with the polyethylene drum. Such backer plates are dimensioned to be adjustable and to compensate for the loss proximity between the backer plates and the polyethylene drum inner wall (interior surface 12). This change yields the unpredicted and unexpected result of applying additional pressure to the mixing batch.

In a non-limiting exemplary embodiment, a horizontally opposed pair of air-generating paddles (first pair 22*a*-22*b*, second pair 22*c*-22*d*; collectively 22 or 22*a*-22*d*) are located at both ends of the rectilinear shaft 13. Such horizontally opposed pair of air-generating paddles 22*a*-22*d* are perpendicularly positioned and adjacent to both the tow-end 16 and the engine-end 17 of the rectilinear shaft 13. Each horizontally opposed pair of air-generating paddles 22 pump air into the rotating batch and increase the entrained air level of the mixed mortar. These air-generating paddles 22*a*-22*d* also apply unique perpendicular and horizontal mixing pressures to the laterally rotating mortar mixture batch. Employing two pairs of horizontally opposed air-generating paddles 22*a*-22*d* yields the unpredicted and unexpected result of significantly increases the applied perpendicular and horizontal mixing pressures to the rotating mortar at the rectilinear shaft ends 16, 17, thereby substantially reducing undesirable clumps of sand and mortar at the rectilinear shaft 13.

In a non-limiting exemplary embodiment, the air-generating paddles 22*a*-22*d* yield the unpredicted and unexpected result of significantly increasing the level of entrained air which in turn produces a creamy (e.g., homogenous) mortar mixture. This creamy mixture has greater spread ability because the mortar is smooth and has less drag on the mason's trowel. Sand that may be coarse grained now spreads like the finer and more expensive grained sands because of the lubricating properties of the minute air bubbles contained in the entrained air. This mixed mortar has an extended period of plasticity thus improving the mason's productivity.

In a non-limiting exemplary embodiment, the combination of air-generating paddles 22 and venturi mid-paddles 44 yields the unpredicted and unexpected result of cooling—reducing—the temperature of the completed mortar mixture by more than six degrees compared to a same size mortar mixture produced by a conventional mortar mixer in a conventional steel drum 11. This cooler temperature contributes to the extended period of plasticity and increases the mortar mixture's pan life. This eliminates the need for adding additional water to soften the somewhat stale mortar that may remain in the pan. This process is called "reconstituting the mortar" and requires additional labor. The present disclosure overcomes this shortcoming.

In a non-limiting exemplary embodiment, the combination of air-generating paddles 22 and venturi mid-paddles 44 yields the unpredicted and unexpected result of reducing the mortar mixing time by approximately 40%, which improves jobsite productivity (e.g., reduces labor costs).

In a non-limiting exemplary embodiment, the combination of air-generating paddles 22 and venturi mid-paddles 44 yields the unpredicted and unexpected result of applying unique mixing pressures during the mortar mixing process, thereby resulting in a self-cleaning ability due to complete mortar batch rotation within the polyethylene drum and horizontal inner (core) mortar mixture movement that occurs during the mortar mixing process. The two new venturi mid-paddles 44*a*, 44*b* (collectively at 44) apply an increased velocity to the stagnant slurry flow along the rectilinear shaft 13. This stagnant slurry flow is now redirected upwards by the two venturi mid-paddles 44 and into the faster, outer, lateral high-speed mortar batch flow. Such new additional applied internal pressures yield the unpredicted and unexpected result of reducing the likelihood of mortar clinging to the paddle arms 18 and rectilinear shaft 13, which is the typical, undesirable location of mortar build-up.

One skilled in the art of mortar masonry understands that any build-up of old mortar on the paddle arms 18 and rectilinear shaft 13 is difficult to clean. This buildup reduces the rotational operating speed of the mortar mixer and reduces the batch size of the produced mortar. This unwanted mortar buildup adds hidden cost to each produced mortar batch. This unwanted buildup also changes the actual specification of the produced mortar batch because the required mortar batch sand cannot be added due to the volume capacity reduction of the polyethylene drum as a result of the unwanted mortar build-up.

Referring generally to FIGS. 1-5, a portable mortar mixer paddle assembly 10 is illustrated for operating at a slow mixing speed, within a polyethylene drum. The portable mortar mixer paddle assembly 10 captures entrained air to provide creamy and consistent mortar without the use of chemical additives. This entrained air-rich mortar is more easily removed than the conventional mixed mortars thereby making it easier to clean the polyethylene drum and portable mortar mixer paddle assembly 10 on the jobsite at day's end.

In a non-limiting exemplary embodiment, the combination of air-generating paddles 22 and venturi mid-paddles 44 yields the unpredicted and unexpected result of complete mortar batch rotation (CBR) within the polyethylene drum during the mortar mixing process. Visible lateral rotation (along arcuate travel paths 41) of the complete mortar batch can easily be verified by looking down into the top opening of the polyethylene drum.

To achieve the unpredicted and unexpected result of CBR in a polyethylene drum wherein the paddles (collectively at 22, 32, 42, 44) do not touch the interior surface 12 of the polyethylene drum, three levels of applied pressure (force) must be present during the mortar mixing process. The first level of applied pressure to the mortar batch is delivered by the engine-end 17 lateral paddle 32*a* and lateral mid-paddle 42*a*, and the tow-end 16 lateral paddle 32*b* and lateral mid-paddle 42*b*. These four lateral paddles 32, 42 supply the lateral pressure to the mortar batch. The second level of applied pressure is produced by the two pair of air-generating paddles 22. Each pair 22*a*-22*b*, 22*c*-22*d* of these air-generating paddles 22 are horizontally opposed (180 degrees apart) and joined at their bases located at each rectilinear shaft end 16, 17, and perpendicular to the rectilinear shaft 13. One pair 22*c*-22*d* of the air-generating paddles 22 is located adjacent to the engine-end 17 lateral paddle 32*b*, and another pair 22*a*-22*b* of the air-generating paddles 22 is located adjacent to the tow-end 16 lateral paddle 32*a*. Once all the mortar batch material has been placed into the polyethylene drum, horizontal pressure moves the entrained air-enriched mortar from the tow-end 16 of the shaft 13 to the engine-end 17 of the shaft 13, and then the mortar returns back towards the tow-end 16 of the shaft 13 with each complete revolution of the shaft 13. The third level of applied pressure is produced by two unique venturi mid-paddles 44 (e.g., venturi mid-paddles 44*a*, 44*b*). These two venturi mid-paddles 44*a*, 44*b* are mounted on mid-paddle arm group 18*b* at the midpoint of the rectilinear shaft 13. One venturi mid-paddle 44*a* is orientated towards the tow-end 16 of the shaft 13 and the other venturi mid-paddle 44*b* is orientated towards the engine-end 17 of the shaft 13. The venturi mid-paddles 44*a*, 44*b* apply redirected pressure to the mortar slurry flow which surrounds the rectilinear shaft 13 and forces this mortar slurry flow and undesirable sand clumps to return into the faster moving upper lateral streams of mixing mortar flow. Such faster moving upper lateral streams (arcuate travel paths 41) are located away from the rectilinear shaft 13 and adjacent to the interior surface 12 of the polyethylene drum.

These three applied force levels in the polyethylene drum yield the unpredicted and unexpected result of CBR in a polyethylene drum wherein the paddles 22, 32, 42, 44 do not touch the interior surface 12 of the polyethylene drum. Thus, the final product is a highest quality mortar mixture in the least amount of mixing time and without the use of expensive additives. This produced mortar mixture does not contain sand clumps and contains elevated levels of entrained air derived from the mixing process.

In a non-limited exemplary embodiment, when only the four air-generating paddles 22 are installed on a conventional mixer, the ability to enjoy these benefits are possible. For example, an elevated level of entrained air which delivers the best spread ability, stays plastic (pliable) for a longer time, becomes available at minimum cost, thereby improving the actual productivity of the mason.

Referring to FIGS. 1-5 in general, a mortar mixer paddle assembly 10 for operating at a slow mixing speed inside a polyethylene drum is illustrated. The mortar mixer paddle assembly 10 includes a rectilinear shaft 13 having a centrally registered longitudinal axis 14 and configured to be operably rotated at a slow mixing speed within an existing polyethylene drum for mixing a mortar batch, wherein the rectilinear shaft 13 includes a tow-end 16 and an engine-end 17 axially opposed from the tow-end 16. The rectilinear shaft 13 is configured to be operably articulated along a unidirectional counter clockwise rotation 15 while positioned in the existing polyethylene drum for preparing a mortar mixture.

In a non-limiting exemplary embodiment, the mechanism 20 for entraining air into the mortar mixture and along the rectilinear shaft 13 inside the existing polyethylene drum includes a plurality of air-generating paddles 22 statically coupled to said rectilinear shaft 13 and are arranged in a pre-defined orientation relative to the tow-end 16 and the engine-end 17 of the rectilinear shaft 13.

In a non-limiting exemplary embodiment, the mechanism 30 for horizontally reciprocating a mortar mixture slurry along a bi-directional linear travel path 31 parallel to the centrally registered longitudinal axis 14 of the rectilinear shaft 13 includes a plurality of lateral paddles 32 statically affixed to a first group 18*a* of the paddle arms 18 and are spaced from the air-generating paddles 22, respectively.

In a non-limiting exemplary embodiment, the mechanism 40 for radially redirecting slow-moving mortar mixture slurry, traveling along the rectilinear shaft 13, upwards into faster moving arcuate travel paths 41 rotating about the rectilinear shaft 13 includes a plurality of venturi mid-paddles 44 statically affixed to a second group 18*b* of the paddle arms 18 and being intermediately positioned between the plurality of air-generating paddles 22 and the plurality of lateral paddles 32. In addition, mechanism 40 further includes a plurality of lateral mid-paddles 42 statically affixed to the second group 18*b* of the paddle arms 18 and intermediately positioned between the plurality of air-generating paddles 22 and the plurality of lateral paddles 32. Each of the plurality of venturi mid-paddles 44 has a trapezoidal shape. Advantageously, the plurality of venturi mid-paddles 44 are juxtaposed to the plurality of lateral mid-paddles 42, respectively, and share the same paddle arm 18*b*, respectively.

In a non-limiting exemplary embodiment, the plurality of air-generating paddles 22 include a first pair 22*a*-22*b* of air-generating paddles 22 registered along a first x-axis 24 and disposed adjacent to the tow-end 16 of the rectilinear shaft 13, and a second pair 22*c*-22*d* of air-generating paddles 22 registered along a second x-axis 26 and disposed adjacent to the engine-end 17 of the rectilinear shaft 13. Notably, the first x-axis 24 is oriented parallel to the second x-axis 26, and orthogonal to the centrally registered longitudinal axis 14 (which is a y-axis 50).

In a non-limiting exemplary embodiment, the plurality of lateral paddles 32 include a first lateral paddle 32*a* registered along a first z-axis 36 and disposed adjacent to the tow-end 16 of the rectilinear shaft 13, and a second lateral paddle 32*b* registered along a second z-axis 38 and disposed adjacent to the engine-end 17 of the rectilinear shaft 13. Each of the first lateral paddle 32*a* and the second lateral paddle 32*b* are oriented substantially perpendicular to each of the first pair 22*a*-22*b* of air-generating paddles 22 and the second pair 22*c*-22*d* of air-generating paddles 22. Advantageously, the first lateral paddle 32*a* is coextensively shaped to the second lateral paddle 32*b*. Notably, each of first z-axis 36 and second z-axis 38 are obliquely angled relative to first x-axis 24 and second x-axis 26 as well as said y-axis 50.

In a non-limiting exemplary embodiment, the plurality of lateral mid-paddles 42 includes a first lateral mid-paddle 42*a* intermediately positioned between the tow-end 16 and the engine-end 17 of the rectilinear shaft 13, and a second lateral mid-paddle 42*b* intermediately positioned between the tow-end 16 and the engine-end 17 of the rectilinear shaft 13. Advantageously, the second lateral mid-paddle 42*b* is opposed from and oppositely facing the first lateral mid-paddle 42*a*. Advantageously, the first lateral mid-paddle 42*a* and the second lateral mid-paddle 42*b* are equidistantly offset from the rectilinear shaft 13.

In a non-limiting exemplary embodiment, the plurality of venturi mid-paddles 44 includes a first venturi mid-paddle 44*a* mounted adjacent to the first lateral mid-paddle 42*a* and configured to rotate in sync with the first lateral mid-paddle 42*a* thereby causing the mortar mixture slurry to horizontally flow along the y-axis 50 towards the engine-end 17 of the rectilinear shaft 13. A second venturi mid-paddle 44*b* is mounted adjacent to the second lateral mid-paddle 42*b* and configured to rotate in sync with the second lateral mid-paddle 42*b* thereby causing the mortar mixture to horizontally flow along the y-axis 50 towards the tow-end 16 of the rectilinear shaft 13. Thus, reciprocating linear movement of slurry is directed along y-axis 50. Advantageously, the first venturi mid-paddle 44*a* is oppositely positioned across from the rectilinear shaft 13 relative to a position of the second venturi mid-paddle 44*b*. Notably, the first venturi mid-paddle 44*a* is coextensively shaped to the second venturi mid-paddle 44*b*.

In a non-limiting exemplary embodiment, the two air-generating paddles of the first pair 22*a*-22*b* of air-generating paddles 22 are transversely offset 180 degrees relative to each other and oriented perpendicular to the centrally registered longitudinal axis 14 of the rectilinear shaft 13. Such a pair of paddles 22*a*-22*b* are located adjacent to the interior surface 12 of the existing polyethylene drum at the tow-end 16 of the rectilinear shaft 13. Similarly, the two air-generating paddles of the second pair 22*c*-22*d* of air-generating paddles 22 are transversely offset 180 degrees relative to each other and oriented perpendicular to the centrally registered longitudinal axis 14 of the rectilinear shaft 13. Such a pair of paddles 22*c*-22*d* are located adjacent to the interior surface 12 of the existing polyethylene drum at the engine-end 17 of the rectilinear shaft 13.

The present disclosure further includes a method of utilizing a mortar mixer paddle assembly 10 for operating at a slow mixing speed inside a polyethylene drum. Such a method includes the initial step of: providing a rectilinear shaft 13 having a centrally registered longitudinal axis 14 and configured to be operably articulated along a unidirectional counter clockwise rotation 15 while positioned in an existing polyethylene drum for preparing a mortar mixture. Such a rectilinear shaft 13 include a tow-end 16 and an engine-end 17 axially opposed from the tow-end 16, and a plurality of rectilinear paddle arms 18 radially extending outwardly from the centrally registered longitudinal axis 14.

The method further includes the steps of: providing a mechanism 20 for entraining air into the mortar mixture and along the rectilinear shaft 13 inside the existing polyethylene drum; providing a mechanism 30 for horizontally reciprocating (linearly moving) a mortar mixture slurry along a bi-directional linear travel path 31 parallel to the centrally registered longitudinal axis 14 of the rectilinear shaft 13; and providing a mechanism 40 for radially redirecting slow-moving mortar mixture slurry, traveling along the rectilinear shaft 13, upwards into faster moving arcuate travel paths 41 rotating about the rectilinear shaft 13 thus eliminating mortar mixture slurry build-up on the rectilinear shaft 13 and the rectilinear paddle arms 18; and producing a consistent and creamy mortar mixture while minimizing the mortar mixture slurry undesirably stuck to the rectilinear shaft 13.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A mortar mixer paddle assembly for operating at a slow mixing speed inside a polyethylene drum, said mortar mixer paddle assembly comprising:

a rectilinear shaft having a centrally registered longitudinal axis and configured to be operably articulated while positioned in an existing polyethylene drum for preparing a mortar mixture, said rectilinear shaft including a tow-end and an engine-end axially opposed from said tow-end, and a plurality of rectilinear paddle arms extending outwardly from the centrally registered longitudinal axis;

means for entraining air into the mortar mixture and along said rectilinear shaft inside the existing polyethylene drum;

means for horizontally reciprocating a mortar mixture slurry along a bi-directional linear travel path parallel to the centrally registered longitudinal axis of said rectilinear shaft; and means for radially redirecting slow-moving mortar mixture slurry, traveling along said rectilinear shaft, upwards into faster moving arcuate travel paths rotating about said rectilinear shaft thus eliminating mortar mixture slurry build-up on said rectilinear shaft and said rectilinear paddle arms;

wherein said means for entraining air into the mortar mixture and along said rectilinear shaft inside the existing polyethylene drum comprises a plurality of air-generating paddles statically coupled to said rectilinear shaft and being arranged in a pre-defined orientation relative to said tow-end and said engine-end of said rectilinear shaft;

wherein said means for horizontally reciprocating a mortar mixture slurry along a bi-directional linear travel path parallel to the centrally registered longitudinal axis of said rectilinear shaft comprises a plurality of lateral paddles statically affixed to a first group of said paddle arms and being spaced from said air-generating paddles, respectively;

wherein said means for radially redirecting slow-moving mortar mixture slurry, traveling along said rectilinear shaft, upwards into faster moving arcuate travel paths rotating about said rectilinear shaft comprises a plurality of venturi mid-paddles statically affixed to a second group of said paddle arms and being intermediately positioned between said plurality of air-generating paddles and said plurality of lateral paddles, and a plurality of lateral mid-paddles statically affixed to said second group of said paddle arms and being intermediately positioned between said plurality of air-generating paddles and said plurality of lateral paddles;

wherein each of said plurality of venturi mid-paddles has a trapezoidal shape;

wherein said plurality of venturi mid-paddles are juxtaposed to said plurality of lateral mid-paddles, respectively;

wherein said plurality of air-generating paddles comprise a first pair of air-generating paddles registered along a first x-axis and being disposed adjacent to said tow-end of said rectilinear shaft, and a second pair of air-generating paddles registered along a second x-axis and being disposed adjacent to said engine-end of said rectilinear shaft;

wherein said first x-axis is oriented parallel to said second x-axis and orthogonal to the centrally registered longitudinal axis of said rectilinear shaft wherein the centrally registered longitudinal axis is a y-axis.

2. The mortar mixer paddle assembly of claim 1, wherein said plurality of lateral paddles comprise:

a first lateral paddle registered along a first z-axis and being disposed adjacent to said tow-end of said rectilinear shaft; and a second lateral paddle registered along a second z-axis and being disposed adjacent to said engine-end of said rectilinear shaft;

wherein each of said first lateral paddle and said second lateral paddle are oriented substantially perpendicular to each of said first pair of air-generating paddles and said second pair of air-generating paddles;

wherein said first lateral paddle is coextensively shaped to said second lateral paddle;

wherein each of said first z-axis and said second z-axis are obliquely angled relative to said first x-axis and said second x-axis as well as said y-axis.

3. The mortar mixer paddle assembly of claim 2, wherein said plurality of lateral mid-paddles comprises:

a first lateral mid-paddle intermediately positioned between said tow-end and said engine-end of said rectilinear shaft; and a second lateral mid-paddle intermediately positioned between said tow-end and said engine-end of said rectilinear shaft, said second lateral mid-paddle being opposed from and oppositely facing said first lateral mid-paddle;

wherein said first lateral mid-paddle and said second lateral mid-paddle are equidistantly offset from said rectilinear shaft.

4. The mortar mixer paddle assembly of claim 3, wherein said plurality of venturi mid-paddles comprises:

a first venturi mid-paddle mounted adjacent to said first lateral mid-paddle and being configured to rotate in sync with said first lateral mid-paddle thereby causing the mortar mixture slurry to horizontally flow along the y-axis towards said engine-end of said rectilinear shaft;

a second venturi mid-paddle mounted adjacent to said second lateral mid-paddle and being configured to rotate in sync with said second lateral mid-paddle thereby causing the mortar mixture to horizontally flow along the y-axis towards said tow-end of said rectilinear shaft;

wherein said first venturi mid-paddle is oppositely positioned across from said rectilinear shaft relative to a position of said second venturi mid-paddle;

wherein said first venturi mid-paddle is coextensively shaped to said second venturi mid-paddle.

5. The mortar mixer paddle assembly of claim 4, wherein said first pair of air-generating paddles is transversely offset 180 degrees relative to the centrally registered longitudinal axis of said rectilinear shaft and located adjacent to the interior surface of the existing polyethylene drum at said tow-end of said rectilinear shaft;

wherein said second pair of air-generating paddles is transversely offset 180 degrees relative to the centrally registered longitudinal axis of said rectilinear shaft and located adjacent to the interior surface of the existing polyethylene drum at said engine-end of said rectilinear shaft.

6. A mortar mixer paddle assembly for operating at a slow mixing speed inside a polyethylene drum, said mortar mixer paddle assembly comprising:

a rectilinear shaft having a centrally registered longitudinal axis and configured to be operably articulated along a unidirectional counter clockwise rotation while positioned in an existing polyethylene drum for preparing a mortar mixture, said rectilinear shaft including a tow-end and an engine-end axially opposed from said tow-end, and a plurality of rectilinear paddle arms radially extending outwardly from the centrally registered longitudinal axis;

means for entraining air into the mortar mixture and along said rectilinear shaft inside the existing polyethylene drum;

means for horizontally reciprocating a mortar mixture slurry along a bi-directional linear travel path parallel to the centrally registered longitudinal axis of said rectilinear shaft; and means for radially redirecting slow-moving mortar mixture slurry, traveling along said rectilinear shaft, upwards into faster moving arcuate travel paths rotating about said rectilinear shaft thus eliminating mortar mixture slurry build-up on said rectilinear shaft and said rectilinear paddle arms;

wherein said means for entraining air into the mortar mixture and along said rectilinear shaft inside the existing polyethylene drum comprises a plurality of air-generating paddles statically coupled to said rectilinear shaft and being arranged in a pre-defined orientation relative to said tow-end and said engine-end of said rectilinear shaft;

wherein said means for horizontally reciprocating a mortar mixture slurry along a bi-directional linear travel path parallel to the centrally registered longitudinal axis of said rectilinear shaft comprises a plurality of lateral paddles statically affixed to a first group of said paddle arms and being spaced from said air-generating paddles, respectively;

wherein said means for radially redirecting slow-moving mortar mixture slurry, traveling along said rectilinear shaft, upwards into faster moving arcuate travel paths rotating about said rectilinear shaft comprises a plurality of venturi mid-paddles statically affixed to a second group of said paddle arms and being intermediately positioned between said plurality of air-generating paddles and said plurality of lateral paddles, and a plurality of lateral mid-paddles statically affixed to said second group of said paddle arms and being intermediately positioned between said plurality of air-generating paddles and said plurality of lateral paddles;

wherein each of said plurality of venturi mid-paddles has a trapezoidal shape;

wherein said plurality of venturi mid-paddles are juxtaposed to said plurality of lateral mid-paddles, respectively;

wherein said plurality of air-generating paddles comprise a first pair of air-generating paddles registered along a first x-axis and being disposed adjacent to said tow-end of said rectilinear shaft, and a second pair of air-generating paddles registered along a second x-axis and being disposed adjacent to said engine-end of said rectilinear shaft;

wherein said first x-axis is oriented parallel to said second x-axis and orthogonal to the centrally registered longitudinal axis of said rectilinear shaft;

wherein the centrally registered longitudinal axis is a y-axis.

7. The mortar mixer paddle assembly of claim 6, wherein said plurality of lateral paddles comprise:

a first lateral paddle registered along a first z-axis and being disposed adjacent to said tow-end of said rectilinear shaft; and a second lateral paddle registered along a second z-axis and being disposed adjacent to said engine-end of said rectilinear shaft;

wherein each of said first lateral paddle and said second lateral paddle are oriented substantially perpendicular to each of said first pair of air-generating paddles and said second pair of air-generating paddles;

wherein said first lateral paddle is coextensively shaped to said second lateral paddle;

wherein each of said first z-axis and said second z-axis are obliquely angled relative to said first x-axis and said second x-axis as well as said y-axis.

8. The mortar mixer paddle assembly of claim 7, wherein said plurality of lateral mid-paddles comprises:

a first lateral mid-paddle intermediately positioned between said tow-end and said engine-end of said rectilinear shaft; and a second lateral mid-paddle intermediately positioned between said tow-end and said engine-end of said rectilinear shaft, said second lateral mid-paddle being opposed from and oppositely facing said first lateral mid-paddle;

wherein said first lateral mid-paddle and said second lateral mid-paddle are equidistantly offset from said rectilinear shaft.

9. The mortar mixer paddle assembly of claim 8, wherein said plurality of venturi mid-paddles comprises:

a first venturi mid-paddle mounted adjacent to said first lateral mid-paddle and being configured to rotate in sync with said first lateral mid-paddle thereby causing the mortar mixture slurry to horizontally flow along the y-axis towards said engine-end of said rectilinear shaft;

a second venturi mid-paddle mounted adjacent to said second lateral mid-paddle and being configured to rotate in sync with said second lateral mid-paddle thereby causing the mortar mixture to horizontally flow along the y-axis towards said tow-end of said rectilinear shaft;

wherein said first venturi mid-paddle is oppositely positioned across from said rectilinear shaft relative to a position of said second venturi mid-paddle;

wherein said first venturi mid-paddle is coextensively shaped to said second venturi mid-paddle.

10. The mortar mixer paddle assembly of claim 9, wherein said first pair of air-generating paddles is transversely offset 180 degrees relative to the centrally registered longitudinal axis of said rectilinear shaft and located adjacent to the interior surface of the existing polyethylene drum at said tow-end of said rectilinear shaft;

wherein said second pair of air-generating paddles is transversely offset 180 degrees relative to the centrally registered longitudinal axis of said rectilinear shaft and located adjacent to the interior surface of the existing polyethylene drum at said engine-end of said rectilinear shaft.

11. A method of utilizing a mortar mixer paddle assembly for operating at a slow mixing speed inside a polyethylene drum, said method comprising the steps of:

providing a rectilinear shaft having a centrally registered longitudinal axis and configured to be operably articulated along a unidirectional counter clockwise rotation while positioned in an existing polyethylene drum for preparing a mortar mixture, said rectilinear shaft including a tow-end and an engine-end axially opposed from said tow-end, and a plurality of rectilinear paddle arms radially extending outwardly from the centrally registered longitudinal axis;

providing a mechanism for entraining air into the mortar mixture and along said rectilinear shaft inside the existing polyethylene drum;

providing a mechanism for horizontally reciprocating a mortar mixture slurry along a bi-directional linear travel path parallel to the centrally registered longitudinal axis of said rectilinear shaft; and providing a mechanism for radially redirecting slow-moving mortar mixture slurry, traveling along said rectilinear shaft, upwards into faster moving arcuate travel paths rotating about said rectilinear shaft thus eliminating mortar mixture slurry build-up on said rectilinear shaft and said rectilinear paddle arms; and producing a consistent and creamy mortar mixture while minimizing the mortar mixture slurry stuck to said rectilinear shaft;

wherein said mechanism for entraining air into the mortar mixture and along said rectilinear shaft inside the existing polyethylene drum comprises a plurality of air-generating paddles statically coupled to said rectilinear shaft and being arranged in a pre-defined orientation relative to said tow-end and said engine-end of said rectilinear shaft;

wherein said mechanism for horizontally reciprocating a mortar mixture slurry along a bi-directional linear travel path parallel to the centrally registered longitudinal axis of said rectilinear shaft comprises a plurality of lateral paddles statically affixed to a first group of said paddle arms and being spaced from said air-generating paddles, respectively;

wherein said mechanism for radially redirecting slow-moving mortar mixture slurry, traveling along said rectilinear shaft, upwards into faster moving arcuate travel paths rotating about said rectilinear shaft comprises a plurality of venturi mid-paddles statically affixed to a second group of said paddle arms and being intermediately positioned between said plurality of air-generating paddles and said plurality of lateral paddles, and a plurality of lateral mid-paddles statically affixed to said second group of said paddle arms and being intermediately positioned between said plurality of air-generating paddles and said plurality of lateral paddles;

wherein each of said plurality of venturi mid-paddles has a trapezoidal shape;

wherein said plurality of venturi mid-paddles are juxtaposed to said plurality of lateral mid-paddles, respectively;

wherein said plurality of air-generating paddles comprise a first pair of air-generating paddles registered along a first x-axis and being disposed adjacent to said tow-end of said rectilinear shaft, and a second pair of air-generating paddles registered along a second x-axis and being disposed adjacent to said engine-end of said rectilinear shaft;

wherein said first x-axis is oriented parallel to said second x-axis and orthogonal to the centrally registered longitudinal axis of said rectilinear shaft;

wherein the centrally registered longitudinal axis is a y-axis.

* * * * *